US007523541B2

(12) United States Patent
Sakama et al.

(10) Patent No.: US 7,523,541 B2
(45) Date of Patent: Apr. 28, 2009

(54) METHOD FOR MANUFACTURING RADIO FREQUENCY IC TAG

(75) Inventors: Isao Sakama, Hiratsuka (JP); Minoru Ashizawa, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/076,030

(22) Filed: Mar. 13, 2008

(65) Prior Publication Data

US 2008/0172860 A1 Jul. 24, 2008

Related U.S. Application Data

(62) Division of application No. 11/300,282, filed on Dec. 15, 2005, now Pat. No. 7,365,686.

(30) Foreign Application Priority Data

May 30, 2005 (JP) ..... 2005-158110

(51) Int. Cl.
*H01P 11/00* (2006.01)

(52) U.S. Cl. ..... 29/600; 29/592.1; 29/601; 340/572.7; 343/700 MS

(58) Field of Classification Search ..... 29/592.1, 29/600–601, 830–847; 340/572.7–572.8; 343/700 MS, 895, 829, 846; 235/492, 462.43, 235/462.46
See application file for complete search history.

(56) References Cited

U.S. PATENT DOCUMENTS 5,288,235 A * 2/1994 Sobhani ..... 29/846
5,566,441 A * 10/1996 Marsh et al. ..... 29/600
6,914,567 B2 7/2005 Trumbull
7,250,867 B2 * 7/2007 Sakama et al. ..... 340/572.7
7,365,686 B2 * 4/2008 Sakama et al. ..... 343/700 MS
2005/0001785 A1 1/2005 Ferguson et al.
2005/0134460 A1 6/2005 Usami
2005/0275539 A1 12/2005 Sakama et al.
2006/0208901 A1 9/2006 Kai et al.

FOREIGN PATENT DOCUMENTS

JP 2003-085501 3/2003
JP 2003-298464 10/2003

* cited by examiner

*Primary Examiner*—Minh Trinh
(74) *Attorney, Agent, or Firm*—Mattingly, Stanger, Malur & Brundidge, PC

(57) ABSTRACT

Method for manufacturing a small radio frequency IC tag, where the radio frequency IC tag which can obtain sufficiently long communication distance with radio wave in the microwave band even if an antenna is made small and the radio frequency IC tag is embedded in metal material. An O-shaped antenna is formed to narrow the width of a neck part in which an IC chip is mounted and widen the width of radiating electrodes constituting radiating part of radio wave. The radiating electrodes are formed into offset structure on right and left sides of the feeding point so that areas of right and left radiating parts of the feeding point in which the IC chip is mounted are unsymmetrical. Further, a ground electrode is provided so that a dielectric body is held between the radiating electrodes and the ground electrode and the radiating electrode is connected to the ground electrode at the side of the dielectric body.

19 Claims, 15 Drawing Sheets

PLAN VIEW SHOWING SURFACE

SECTIONAL VIEW TAKEN ALONG A-A

PLAN VIEW SHOWING BACK

PLAN VIEW
SHOWING SURFACE

SECTIONAL VIEW
TAKEN ALONG A-A

PLAN VIEW
SHOWING BACK

METHOD FOR MANUFACTURING RADIO FREQUENCY IC TAG

CROSS-REFERENCE

This is a divisional application of U.S. Ser. No. 11/300,282, filed Dec. 15, 2005 now U.S. Pat. No. 7,365,686, now allowed, which is incorporated by reference.

BACKGROUND OF THE INVENTION

The present invention relates to a radio frequency IC tag and a method for manufacturing same and more particularly to a radio frequency IC tag having improved structure of an antenna part provided therein and its manufacturing method.

Recently, radio frequency IC tags are widely used for information management or distribution management of articles and structures. Such radio frequency IC tags each include a small IC chip in which information is recorded and a small antenna for transmitting the information recorded in the IC chip by radio and are attached to articles or embedded in structures to be utilized. When information (information concerning attributes of individual articles or structures) recorded in the IC chip is read, a reader/writer is merely held to the radio frequency IC tag to make it possible to communicate with the radio frequency IC tag and read the information recorded in the IC chip without contact.

As such a radio frequency IC tag, the technique disclosed in JP-A-2003-298464 (paragraphs 0067 to 0071 and FIG. 6), for example, is known. In such technique, a microstrip antenna (dipole antenna) including a radiation conductive layer (antenna layer) and a ground layer formed on both sides of a dielectric body is held between a dielectric case made of polypropylene having relatively small dielectric loss. Accordingly, since an antenna part containing an IC chip is covered by a case, the radio frequency IC tag has excellent weather-proof and dust-proof characteristics.

Generally, when the radio frequency IC tag is attached to metal to be used, the communication distance thereof is remarkably reduced due to influence of metal. The technique that the communication distance of the radio frequency IC tag is not reduced even if the tag is attached to metal is disclosed in JP-A-2003-85501 (paragraphs 0010 to 0016 and FIGS. 1 to 3). In the technique disclosed in JP-A-2003-85501, a first antenna is formed through an insulating layer on a conductor constituting the ground and the conductor constitutes a second antenna. A potential difference occurs between the first and second antennas (conductor) due to electrostatic coupling, so that the strength of radio wave radiated by the first antenna is not weakened due to reflection of radio wave by the second antenna and reduction of the communication distance is prevented even if the radio frequency IC tag is attached to metal.

SUMMARY OF THE INVENTION

In any of the prior arts disclosed in the above patent documents, a dipole antenna is used. The dipole antenna requires the length of $\lambda/2$ where $\lambda$ is a wavelength of radio wave in order to radiate radio wave efficiently. Since the efficiency of the antenna is remarkably reduced and communication is difficult when the length is smaller than $\lambda/2$, the radio frequency IC tag having the length smaller than or equal to $\lambda/2$ cannot be structured.

Further, not only dipole antennas but also monopole antennas have the characteristics that influence by metal is increased as the frequency of radio wave is increased.

Accordingly, even if the antenna disclosed in JP-A-2003-85501 is applied to the radio frequency IC tag that is currently studied and makes communication with microwave having the frequency band of 2.4 GHz, the antenna efficiency thereof is reduced, so that the antenna cannot be used with metal. The reduction of the antenna efficiency can be complemented to some degree by increasing the sensitivity of a reader/writer, although an antenna included in the reader/writer has a special shape in this case and accordingly the reader/writer has no generalization to deteriorate handling thereof.

The present invention has been made in view of the above problems and it is an object of the present invention is to provide a small radio frequency IC tag which can attain sufficient communication distance with radio wave in the microwave band even if an antenna is made small and embedded in metal material.

The radio frequency IC tag of the present invention has been devised in order to achieve the above object and includes an IC chip for recording information and an antenna for transmitting the information recorded in the IC chip by radio. The antenna is formed into the three-layer structure comprising a radiating electrode having width that is narrowed at a feeding part in which the IC chip is mounted and including radiating parts of radio wave that spread on both sides of the feeding part and are widened, a ground electrode disposed opposite to one surface of the radiating electrode and connected to an end of the radiating electrode and a dielectric body disposed between the radiating electrode and the ground electrode. The radiating electrode constitutes O-shaped antenna, polygonal antenna or H-shaped antenna of the offset structure that areas of two radiating parts existing on both sides of the feeding part are unsymmetrical. Further, the radiating electrode and the ground electrode are electrically connected to each other at the side of the dielectric material or by means of through-holes. In such structure, the communication distance can be extended by efficient radiation of radio wave from the radiating electrode having wide area and reflected radio wave by the ground electrode even if the antenna of the radio frequency IC tag is made small.

According to the present invention, the radiating electrode constituting the O-shaped antenna or the H-shaped antenna of the offset structure that the radiating parts on right and left sides of the feeding point in which an IC chip is mounted are unsymmetrical is electrically connected to the ground electrode on the back side of the dielectric material held between the radiating electrode and the ground electrode, so that the sufficient communication distance can be ensured with radio wave in the microwave band even if the radio frequency IC tag is smaller than or equal to $0.1\lambda$. Consequently, the radio frequency IC tag can be mounted in a hole formed in the head of a bolt made of metal, for example, and having a diameter of about 10 mm and the depth of about 2 mm. An existing device such as a dipole antenna and a patch antenna can be used to make communication stably without requiring an antenna of a special reader/writer even if the radio frequency IC tag is made small. Further, the auxiliary antenna for amplifying radiated radio wave from the O-shaped antenna or the H-shaped antenna can be provided to further enhance radio wave radiated from the radio frequency IC tag and further extend the communication distance of the radio frequency IC tag.

BRIEF DESCRIPTION OF THE DRAWINGS

FIG. 1A is a plan view illustrating the surface thereof, FIG. 1B being a sectional view taken long line A-A, FIG. 1C being a plan view illustrating the back thereof;

FIG. 3A is a sectional view of the radio frequency IC tag mounted in the metal material, FIG. 3B being a sectional view of the radio frequency IC tag;

FIG. 5A shows a state before forming, FIG. 5B showing a state after forming;

FIG. 7A shows a state before forming, FIG. 7B showing a state after forming;

FIG. 20A is a sectional view of the radio frequency IC tag including no auxiliary antenna, FIG. 20B being a sectional view of the radio frequency IC tag including the auxiliary antenna, FIG. 20C being a top view of the radio frequency IC tag shown in FIG. 20B;

DESCRIPTION OF THE EMBODIMENTS

Referring now to the accompanying drawings, radio frequency IC tags according to the best modes (hereinafter referred to as embodiments) for carrying out the present invention are described by giving preferred examples. The radio frequency IC tag according to the present invention includes an antenna formed into, for example, O-shape, polygon or H-shape having the width that is narrowed in the vicinity of a feeding point of the antenna in which an IC chip is mounted and including a radiating electrode constituting radiating parts of radio wave and having the width widened at peripheries thereof, so that electromagnetic energy is concentrated at the periphery of the IC chip efficiently to improve the antenna efficiency.

The radiating electrode may be formed into a symmetrical structure having right and left radiating parts of the same area provided on right and left sides of the feeding point in which the IC chip is mounted or an unsymmetrical structure. Particularly, when the radiating electrode is formed into O-shape, polygon or H-shape of the unsymmetrical structure in which the feeding point is offset, the radiation efficiency thereof can be increased. Further, a ground electrode is provided on the back side of a dielectric body held between two radiating parts formed on both sides of the feeding point and is electrically connected to any one of the radiating parts at the side of the dielectric body or through through-holes. The radiating part that is electrically connected to the ground electrode has a radiation area smaller than that of the other, so that the radiating part having the larger radiation area has the increased radiation efficiency and when an object to which the radio frequency IC tag is to be attached is metal material, the ground electrode is electrically connected to the metal material, the radiation efficiency is improved. Accordingly, since the communication distance is not made short even if the length of the radiating electrode is shortened, miniaturization of the radio frequency IC tag can be attained.

For example, even when the radiating electrode is made small extremely so that the size of the whole radio frequency IC tag is smaller than or equal to $0.1\lambda$ or even when the radio frequency IC tag is attached to metal, the sufficient communication distance can be ensured with radio wave in the microwave band. Further, an auxiliary antenna can be provided in the antenna including the radiating electrode formed into O-shape, polygon or H-shape. In this case, the intensity of the radiated radio wave can be more enhanced by the amplification effect of the auxiliary antenna to further extend the communication distance.

First Embodiment

Figure 1A:
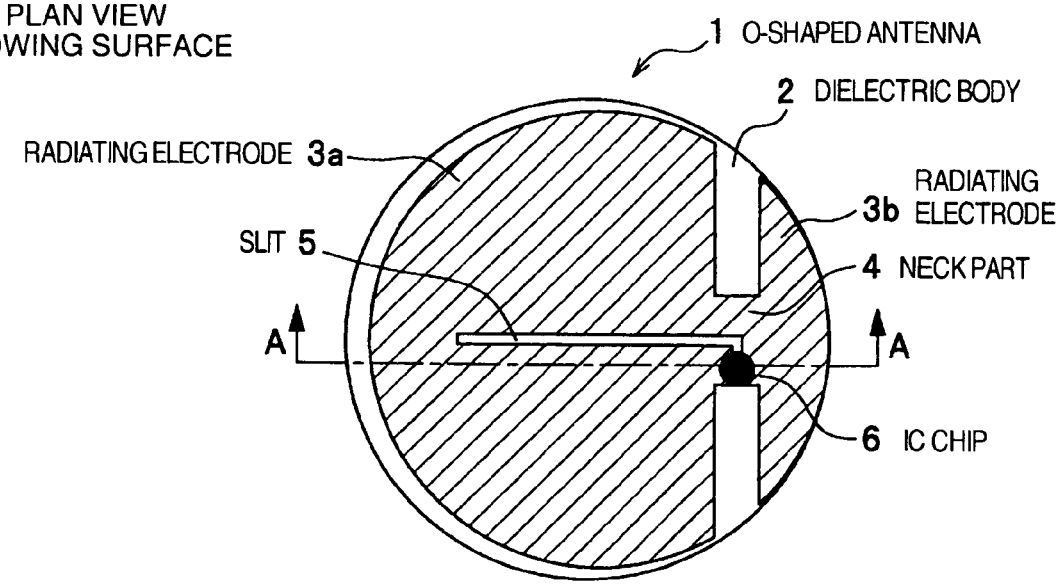
FIGS. 1A to 1C are diagrams illustrating an O-shaped antenna included in a radio frequency IC tag of a first embodiment according to the present invention.
Figure 1B:
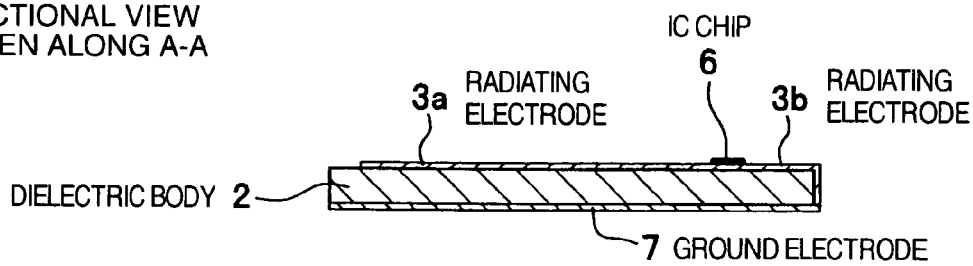
Figure 1C:
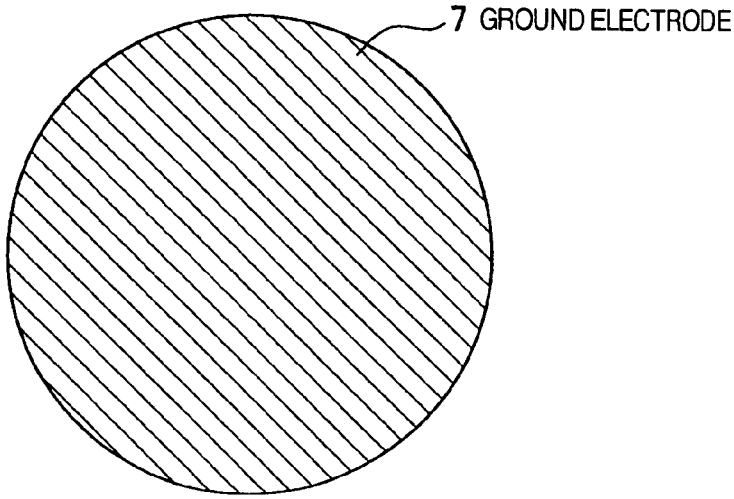
Figure 2A:
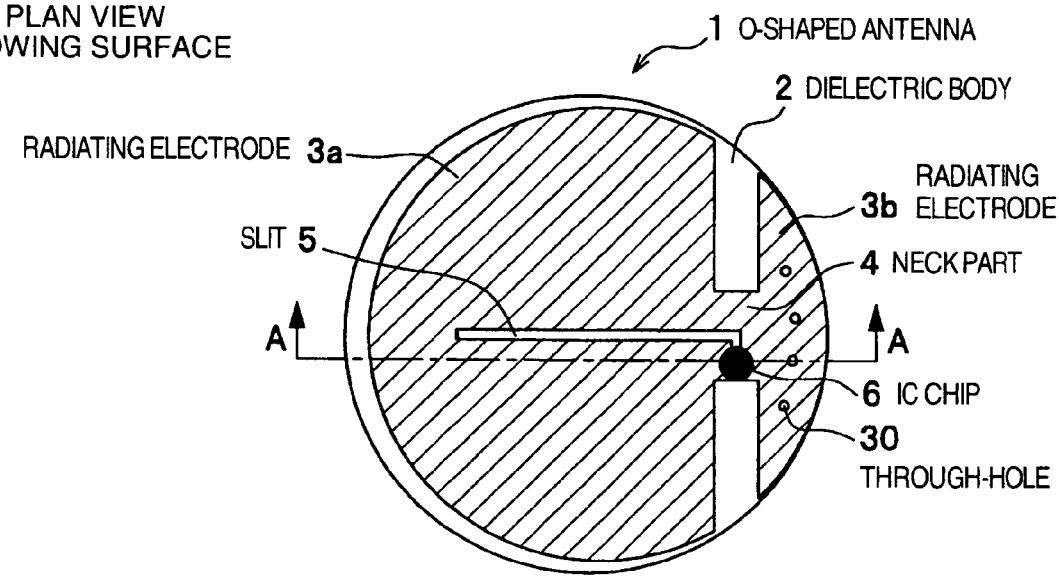
FIGS. 2A to 2C are diagrams illustrating the radio frequency IC tag including a radiating electrode and a ground electrode connected to each other by means of through-holes.
Figure 2B:
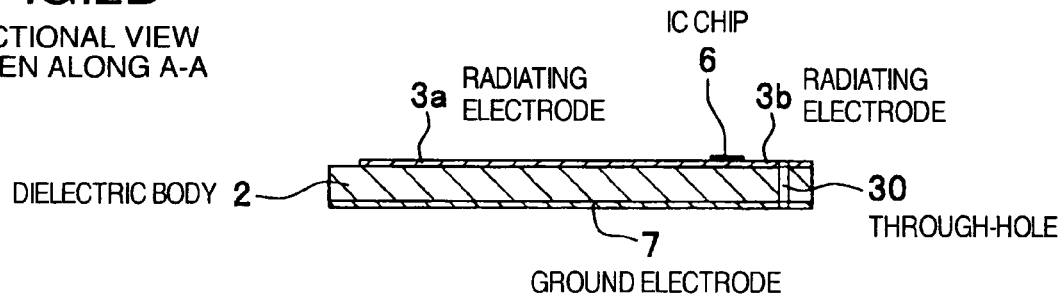
Figure 2C:
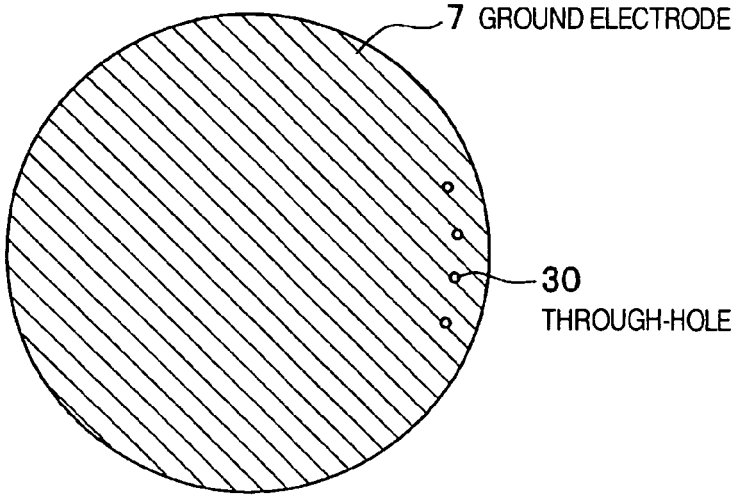

FIGS. 1A to 1C are diagrams illustrating an O-shaped antenna included in a radio frequency IC tag of the first embodiment according to the present invention. FIG. 1A is a plan view illustrating the surface or the obverse of the O-shaped antenna, FIG. 1B is a sectional view of the O-shaped antenna taken along line A-A in FIG. 1A and FIG.

1C is a plan view illustrating the back or the reverse of the O-shaped antenna. As shown in FIGS. 1A to 1C, the O-shaped antenna 1 (radiating electrode) formed into a circle includes two unsymmetrical semicircular radiating electrodes 3*a* and 3*b* formed on the surface of a dielectric body 2 constituting an antenna substrate and an elongated neck part 4 connecting the radiating electrodes 3*a* and 3*b* at the middle portion thereof. Further, a slit 5 is formed from the elongated neck part 4 into the radiating electrode 3*a*. In addition, an IC chip 6 is mounted to straddle the slit 5 in the elongated neck part 4 and respective terminals of the IC chip 6 are connected to electrodes on both sides of the slit 5. The slit 5 forms a countermeasure for preventing the breakdown due to static electricity and an impedance matching circuit for matching an impedance between the IC chip 6 and the radiating electrode 3*a*. A circular ground electrode 7 is disposed on the back of the dielectric body 2. An end of the radiating electrode 3B of the O-shaped antenna 1 is electrically connected to an end of the ground electrode 7 at the side of the dielectric body 2.

In other words, the radiating electrodes 3*a* and 3*b* including the IC chip 6 and the slit 5 (impedance matching circuit) is formed on the surface of the dielectric body 2 as the O-shaped antenna 1 and the end of radiating electrode 3*b* having a smaller radiation area out of the radiating electrodes 3*a*, 3*b* is electrically connected to the end of the ground electrode 7 formed on the back of the dielectric body 2 at the side of the dielectric body 2. Further, the radiating electrode 3*b* may be connected to the ground electrode 7 through a plurality of through-holes passing through the dielectric body 2 at any points. In this case, it is desirable that as many through-holes as possible are provided to connect the radiating electrode 3*b* to the ground electrode 7 through a low impedance.

The O-shaped antenna 1, the ground electrode 7 and the dielectric body 2 constitute the antenna.

When an antenna current flows from the IC chip 6 into the O-shaped antenna 1 as shown in FIG. 1A, a maximum current flows in the neck part 4 in which the IC chip 6 is mounted and further currents flow therefrom into the radiating electrodes 3*a*, 3*b* disposed on both the sides of the neck part. Consequently, electromagnetic energy of the radiating electrodes 3*a*, 3*b* is concentrated to surround the IC chip 6 and accordingly the antenna efficiency is improved even with the small circular O-shaped antenna.

Further, as shown in FIG. 1A, the radiation area of the radiating electrode 3*a* is made larger and the radiating electrode 3*b* having the smaller radiation area is connected to the ground electrode 7, that is, the offset structure on right and left sides of the feeding point is adopted to make it possible to radiate radio wave from the radiating electrode 3*a* having the larger radiation area effectively. Consequently, the antenna efficiency of the O-shaped antenna 1 can be further improved.

Further, the ground electrode 7 is connected to metal material so that the area of the ground electrode is made larger equivalently to thereby improve the radiation efficiency of the antenna and accordingly the communication distance can be more improved even with the small antenna.

The O-shaped antenna 1 as structured above can be realized to have the diameter smaller than or equal to 0.1λ (λ: wavelength of radio wave), that is, the diameter smaller than or equal to 10 mm for the frequency of radio wave of 2.4 GHz, for example. When the diameter of the O-shaped antenna 1 is 10 mm, the communication distance of about 20 mm can be obtained. The antenna is embedded in a bolt of metal, reduction of the antenna efficiency can be suppressed and the same communication distance can be obtained.

Further, when a hole is formed in metal material and the radio frequency IC tag is mounted in the hole, it is desirable that the diameter of the O-shaped antenna 1 including the radiating electrodes 3*a*, 3*b* is substantially smaller than that of the dielectric body 2 (that is, the diameter of the ground electrode 7) as shown in FIG. 1A in order to prevent the radiating electrode 3*a* and ground electrode 7 from being brought into contact with the metal material to short-circuit the radiating electrode 3*a* and ground electrode 7 to each other. The dielectric body 2 may be made of ceramics such as alumina ceramics and mullite ceramics or inorganic material such as glass ceramics or resin material. The resin material may be, for example, polytetrafluorethylene (PTFE), tetrafluoroethylene-ethylene-copolymer resin (ETFE), tetrafluoroethylene-perfluoroalkylvinyleether copolymer resin (PFA), fluorine resin, glass epoxy resin and polyimide.

In addition to these solid materials, inert gases such as air, nitrogen and argon or vacuum may be used.

Further, in order to manufacture the radio frequency IC tag as shown in FIGS. 1A to 1C, the O-shaped antenna 1 composed of the radiating electrodes 3*a*, 3*b* is formed on the surface of a double-sided printed board made of glass epoxy, Teflon (registered trademark) or ceramics and the ground electrode 7 is formed on the back of the double-sided printed board. Further, the slit 5 is formed in the O-shaped antenna 1 and the IC chip 6 is then mounted on the surface of the O-shaped antenna 1. A part of the side of the double-sided printed board is plated to connect the end of the O-shaped antenna 1 to the end of the ground electrode 7. Alternatively, through-holes may be formed in the double-sided printed board to connect the O-shaped antenna 1 to the ground electrode 7.

Further, besides the double-sided printed board, conductive layers made of metal for transmission of high-frequency signal may be formed on the surface and the back of a ceramic substrate by means of the thick film printing method to constitute the O-shaped antenna 1 and the ground electrode 7, for example.

The O-shaped antenna 1 and the ground electrode 7 can be also formed on the ceramic substrate by means of the plating method or the evaporation method. For example, the O-shaped antenna 1 and the ground electrode 7 can be formed by means of the following methods.

(1) An Ni-plated layer and an Au-plated layer are adhered to a Cu layer or an Mo—Mn metalized layer.
(2) An Ni-plated layer and an Au-plated layer are adhered to a W metalized layer.
(3) An Ni-plated layer and an Au-plated layer are adhered to a Cr—Cu alloy layer.
(4) An Ni—Cr alloy layer and an Au-plated layer are adhered to a $Ta_2N$ layer.
(5) A Pt layer and an Au-plated layer are adhered to a Ti layer.
(6) A Pt layer and an Au-plated layer are adhered to an Ni—Cr alloy layer.

Next, mounting of the radio frequency IC tag is described.

Figure 3A:
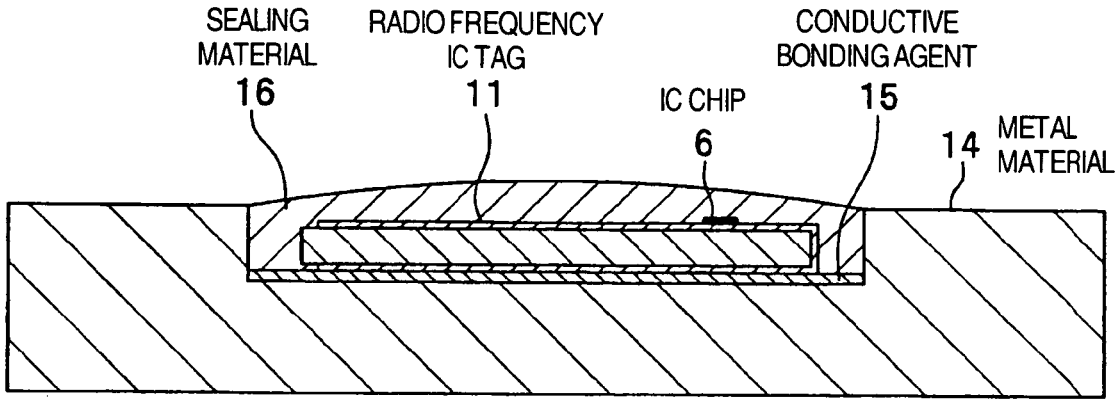
FIGS. 3A and 3B are sectional diagrams illustrating the radio frequency IC tag including the O-shaped antenna shown in FIG. 1 and the metal material in which the radio frequency IC tag is embedded.
Figure 3B:
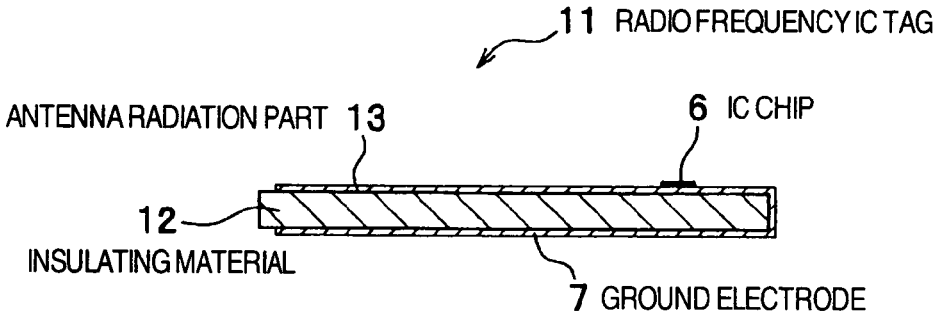
Figure 4:
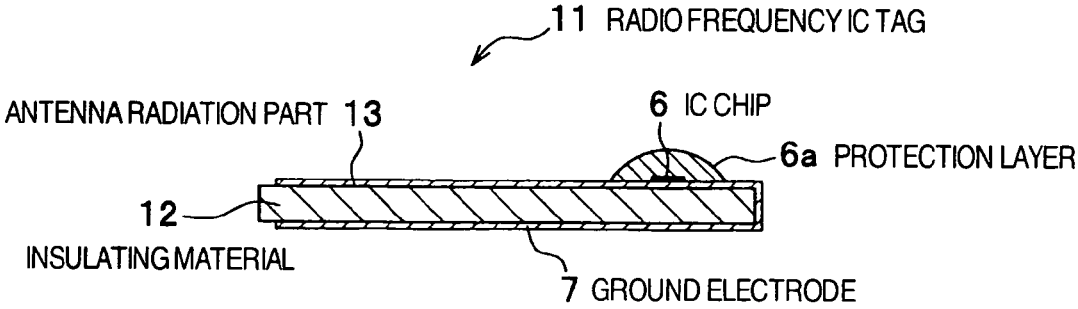
FIG. 4 is a diagram illustrating the radio frequency IC tag in which the IC chip is protected.

FIGS. 3A and 3B are sectional views illustrating the radio frequency IC tag including the O-shaped antenna shown in FIG. 1 and the metal material in which the radio frequency IC tag is embedded. FIG. 3A shows a section of the metal material in which the radio frequency IC tag is mounted or embedded and FIG. 3B shows a section of the radio frequency IC tag to be mounted in the metal material. As shown in FIG. 3B, the radio frequency IC tag 11 includes an antenna radiating part 13 formed on the surface of an insulating material 12 made of dielectric and a ground electrode 7 formed on the back of the insulating material 12. An end of the antenna radiating part 13 and an end of the ground electrode 7 are connected to each other at the side of the insulating material 12 and an IC chip 6 is mounted on the top surface of the antenna radiating part 13.

Further, the antenna radiating part 13 corresponds to the O-shaped antenna 1 shown in FIG. 1 and the insulating material 12 corresponds to the dielectric body 2 shown in FIG. 1.

The antenna radiating part 13 may be formed into O-shape having a neck part offset on right and left sides as shown in FIGS. 1A to 1C or formed into polygon or H-shape having a neck part offset on right and left sides similarly. In any cases, the radiating electrode having a smaller radiation area is connected to the ground electrode 7, so that the antenna efficiency can be increased.

Since the radio frequency IC tag structured above has the diameter smaller than or equal to 10 mm, the radio frequency IC tag can be embedded in the head of a bolt, for example. In this case, as shown in FIG. 3A, a hole having the diameter of abut 10 mm and the depth of about 2 mm is formed in the metal material 14 forming the head of the bolt and a conductive bonding agent 15 is applied on the bottom of the hole. Then, the radio frequency IC tag 11 is embedded into the hole with the ground electrode 7 facing to the bottom of the hole. A gap between the hole of the metal material 14 and the radio frequency IC tag 11 and the upper portion of the radio frequency IC tag 11 are filled with a sealing material 16 such as epoxy resin to seal the hole. Thus, the radio frequency IC tag is attached to the metal material 14 in the embedded state therein and the ground electrode 7 is electrically connected to the metal material 14.

Further, in order to prevent the IC chip 6 from dropping out when the radio frequency IC tag 11 is handled, it is desirable that epoxy resin is dropped toward the antenna radiating part 13 onto the IC chip 6 and is hardened to form a protection layer 6*a* of epoxy resin surrounding the IC chip 6. Thus, it is possible to prevent that the IC chip 6 is dropping out.

Further, the sealing material 16 for sealing the radio frequency IC tag 11 may be low-melting point glass instead of epoxy resin. Since hermetic sealing using such low-melting glass is extremely excellent in the adhesive property to metal and the sealing property, it is preferably used for air-tight terminals of semiconductor devices or high-temperature portions such as engines. The low-melting glass can be used for the sealing material 16 so that heat-resistant temperature can be increased and the radio frequency IC tag can be attached to high-temperature machine such as engine besides the bolt. Further, the melting temperature of the low-melting glass is 320 to 375° C. and the maximum allowable temperature of the IC chip is about 450° C. Accordingly, even when the IC chip is sealed with the low-melting glass, there is no possibility that the IC chip is damaged at high temperature.

As shown in FIG. 3A, the radio frequency IC tag embedded in the metal material 14 has the diameter being as small as about 10 mm but the radiation efficiency of the antenna is excellent. Accordingly, when the reader/writer approaches the surface portion of the radio frequency IC tag 11 to the degree of 20 mm, the reader/writer can read information recorded in the IC chip 6. Further, since the ground electrode 7 is electrically connected to the metal material 14 through the conductive bonding agent 15, the sealing effect of the ground electrode can cut off influence of metal and accordingly even when the small radio frequency IC tag 11 is embedded in the metal material 14, the sufficient communication distance can be ensured and the antenna can receive radio wave in the microwave band even at the usual reading distance to read information recorded in the IC chip 6 exactly.

Figure 5A:
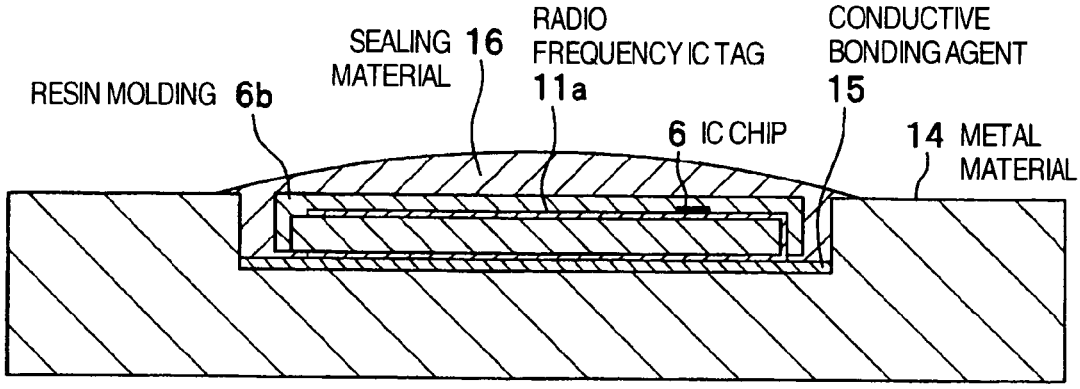
FIGS. 5A and 5B are diagrams illustrating the manufacturing process of the radio frequency IC tag of the second embodiment according to the present invention.
Figure 5B:
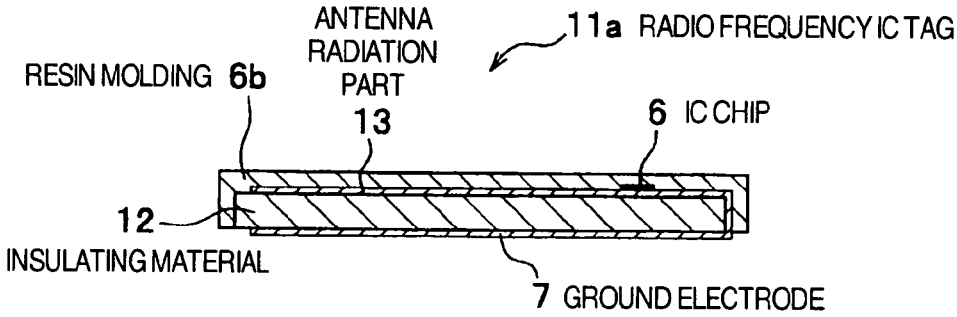

FIGS. 5A and 5B are sectional views illustrating another radio frequency IC tag embedded in the metal material. FIG. 5A shows a section of the metal material and the radio frequency IC tag mounted therein and FIG. 5B shows a section of the radio frequency IC tag to be mounted.

As shown in FIG. 5B, the radio frequency IC tag 11*a* includes a resin molding 6*b* covering the peripheral portion of the insulating material 12 and the upper portions of the antenna radiating part 13 and the IC chip 6 and only the ground electrode 7 is exposed. The resin molding 6*b* enhances the strength of the radio frequency IC tag as compared with the radio frequency IC tag 11 of the substrate-based structure constructed only by the insulating material 12 shown in FIGS. 3A and 3B and the surfaces of the IC chip 6 and the antenna radiating part 13 can be protected. Further, handling of the radio frequency IC tag is also easy. The resin molding 6*b* may be epoxy resin that is material used in semiconductor IC packages, for example.

In mounting of the radio frequency IC tag in the metal material 14, a hole is formed in the metal material 14 as shown in FIG. 5A and the conductive bonding agent 15 is applied to the bottom of the hole. Then, the radio frequency IC tag 11*a* is embedded in the hole. The gap between the hole of the metal material 14 and the radio frequency IC tag 11 and the upper portion of the radio frequency IC tag 11 are filled with the sealing material 16 such as epoxy resin to seal the hole. Thus, the radio frequency IC tag 11*a* is attached to the metal material 14 in the embedded state therein and the ground electrode 7 is electrically connected to the metal material 14.

Figure 6:
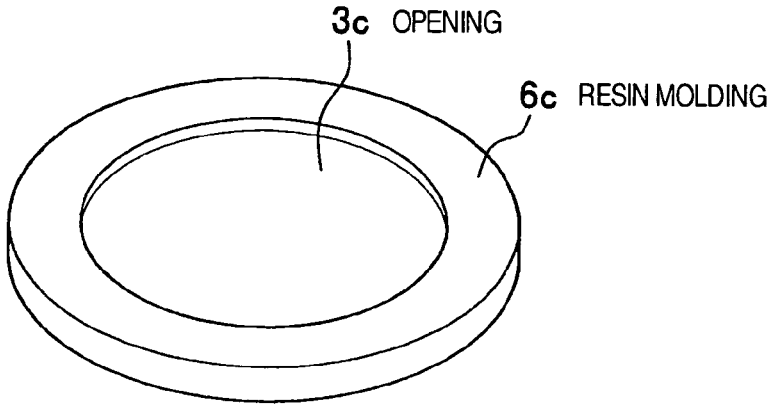
FIG. 6 is a diagram illustrating a shape of a resin molding formed on the surface of the antenna radiating part.

In order to make small the radio frequency IC tag 11 or 11*a*, the antenna radiating part 13 can be made smaller. In this case, the communication distance is sometimes shortened extremely. At this time, if the antenna of the reader/writer is brought into contact with the antenna radiating part 13 to supply energy thereto in order to transfer energy efficiently, the reader/writer can read information recorded in the radio frequency IC tag. To this end, as shown in FIG. 6, the resin molding 6*c* covering the antenna radiating part 13 and the IC chip 6 is formed into a ring so that an opening 3*c* is formed in the position corresponding to the antenna radiating part 13.

Second Embodiment

In the second embodiment, manufacturing of the radio frequency IC tag is described.

Figure 7A:
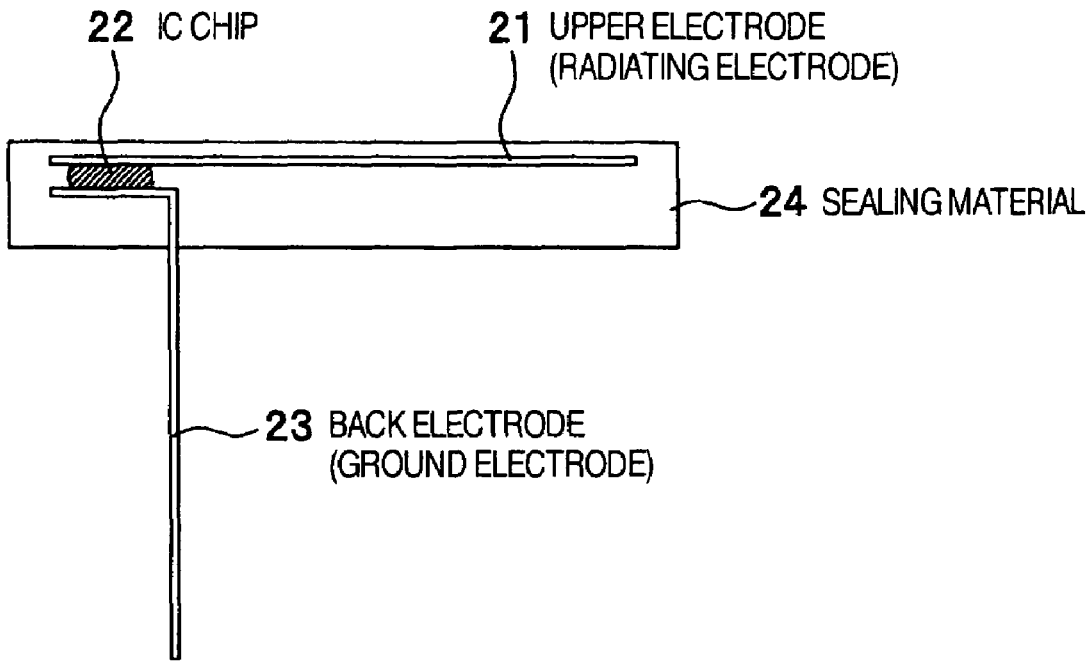
FIGS. 7A and 7B are diagrams illustrating the manufacturing process of the radio frequency IC tag of the second embodiment according to the present invention.
Figure 7B:
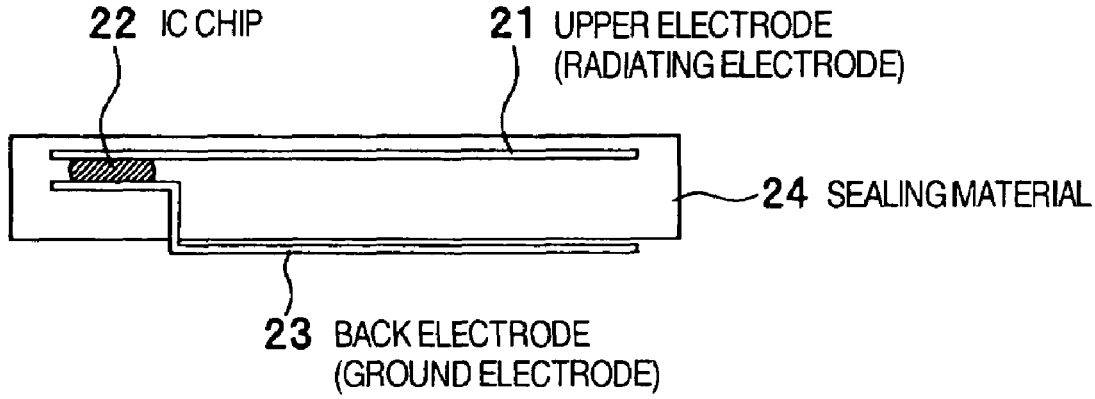

FIGS. 7A and 7B are diagrams illustrating the manufacturing process of the radio frequency IC tag of the second embodiment according to the present invention. FIG. 7A illustrates the radio frequency IC tag which is not subjected to forming and FIG. 7B illustrates the radio frequency IC tag which has been subjected to forming. For example, the O-shaped antenna including the unsymmetrical radiating electrodes as shown in FIG. 1A is disposed in the bottom of a previously prepared container as an upper electrode 21 (that is, radiating electrode) as shown in FIG. 7A. The upper electrode 21 is made of copper alloy (for example, phosphor bronze and brass) or ferroalloy having the thickness of 0.1 to 0.3 mm. Further, metal plate material of the upper electrode 21 is subjected to surface processing of terminals such as solder plating, tinning plating, gold plating and palladium plating.

Next, an IC chip 22 is disposed on the back surface of the upper electrode 21 and terminals of the IC chip 22 are electrically connected to the upper electrode 21 by means of reflowing by conductive paste, ultrasonic bonding by eutectic of Au—Sn or wire bonding.

The IC chip 22 has double-sided electrodes and a back electrode 23 (that is, the ground electrode) is disposed on the back side of the IC chip 22. Other terminals of the IC chip 22 disposed on the back side thereof are electrically connected to the back electrode 23 by the same method as the upper electrode 21. The shape of the back electrode 23 in the longitudinal direction at this point is unrestricted.

A container in which the upper electrode 21, the IC chip 22 and part of the back electrode 23 are mounted or contained is filled with sealing material 24 such as epoxy resin and the sealing material is hardened. The sealing material 24 may be epoxy resin, hermetic sealing material or low-melting glass. A processing temperature in sealing with the low-melting glass is 320 to 375° C. and accordingly the IC chip 22 is not broken down due to sealing. Further, when the antenna is used for a contact-type reader/writer, an opening that is not sealed is formed in a part of the surface of the upper electrode 21 as shown in FIG. 6.

Next, after the sealing resin is hardened, the back electrode 23 is subjected to forming or bent along the back surface of the sealing material 24 as shown in FIG. 7B. Thus, since the radio frequency IC tag is formed with the upper electrode 21 and the back electrode 23 disposed in parallel with each other through the sealing material 24, the radio frequency IC tag can be embedded in the metal material 14 as shown in FIG. 3A, for example. In this case, since the upper electrode 21 (that is, radiating electrode) and the back electrode (that is, ground electrode) are electrically connected to each other by means of the conductivity of the IC chip 22, connection at the side of the dielectric body or connection using the through-holes as shown in FIGS. 1A to 1C or FIGS. 2A to 2C can be omitted. Manufacturing of the radio frequency IC tag using the IC chip having no double-sided electrodes will be described in connection with a following third embodiment.

Third Embodiment

In the third embodiment of the present invention, some variations of mass production of radio frequency IC tags by forming a lot of radiating electrodes and ground electrodes in a lead frame are now described.

<First Variation>

Figure 8:
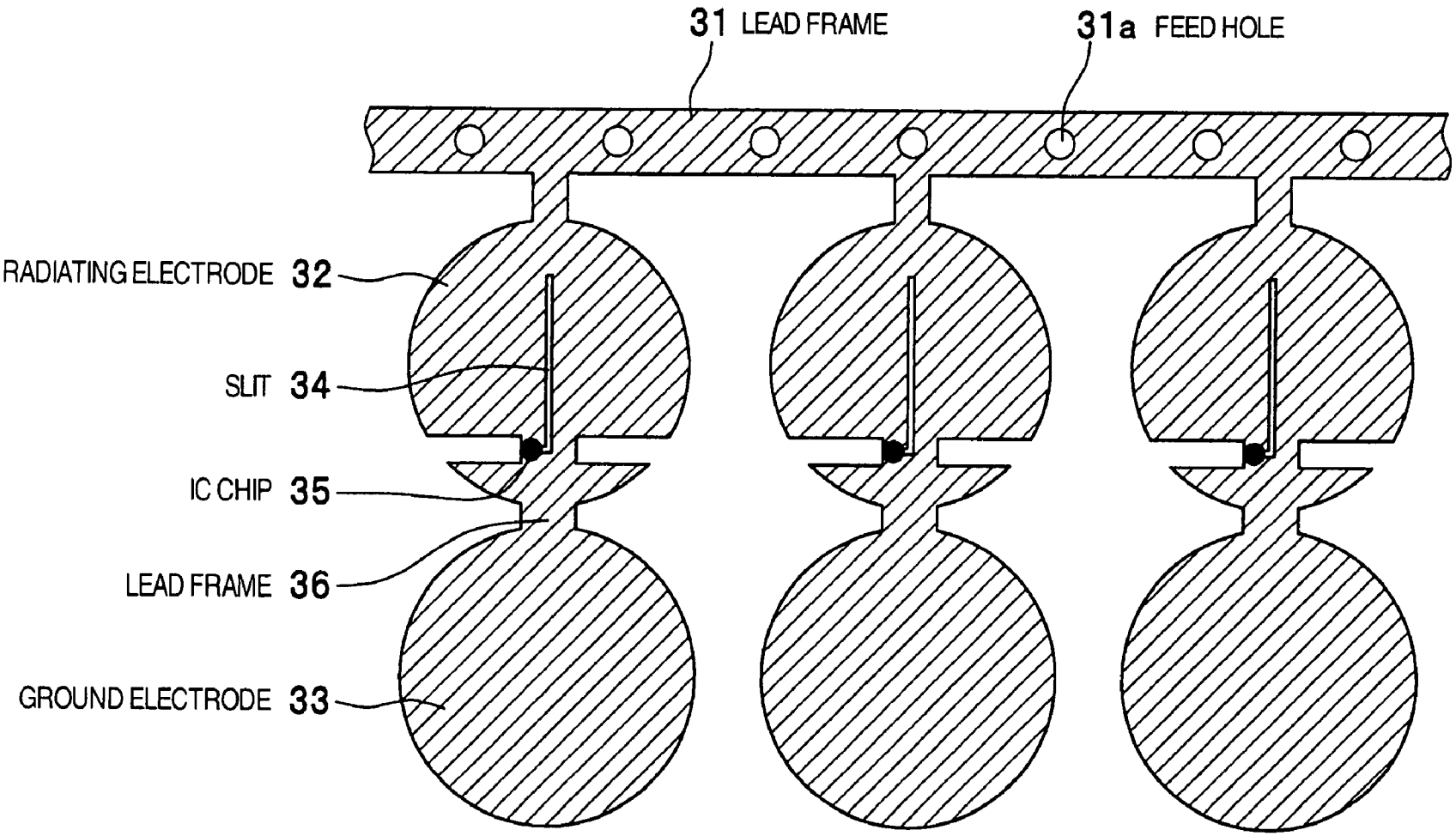
FIG. 8 is a diagram illustrating a first variation of the third embodiment according to the present invention in which a lot of radiating electrodes and ground electrodes are formed in a lead frame.

FIG. 8 is a diagram illustrating the first variation of the third embodiment according to the present invention in which a lot of radiating electrodes and ground electrodes are formed in a lead frame. As shown in FIG. 8, radiating electrodes 32, ground electrodes 33 and slits 34 are formed lengthwise of a beltlike lead frame 31 at equal intervals. The radiating electrodes 32 are formed to have semicircles that are unsymmetrical in the vertical direction and the ground electrodes 33 are formed into a circle. Both the radiating electrodes 32 and the ground electrodes 33 are connected to each other through a short beltlike lead frame 36. Further, feed holes 31*a* are formed in the lead frame 31 at equal intervals. The lead frame 31 is moved at equal pitch while claws of a feeding mechanism of a chip mounter not shown are engaged with the feed holes 31*a* so that IC chips 35 are mounted on the radiating electrode 32. The radiating electrodes 32 are cut off from the lead frame 31 one by one. The antenna part as formed above is sealed with epoxy resin in the substantially same manner as the second embodiment and the ground electrode 33 is subjected to forming so that the radio frequency IC tag is structured.

Figure 9:
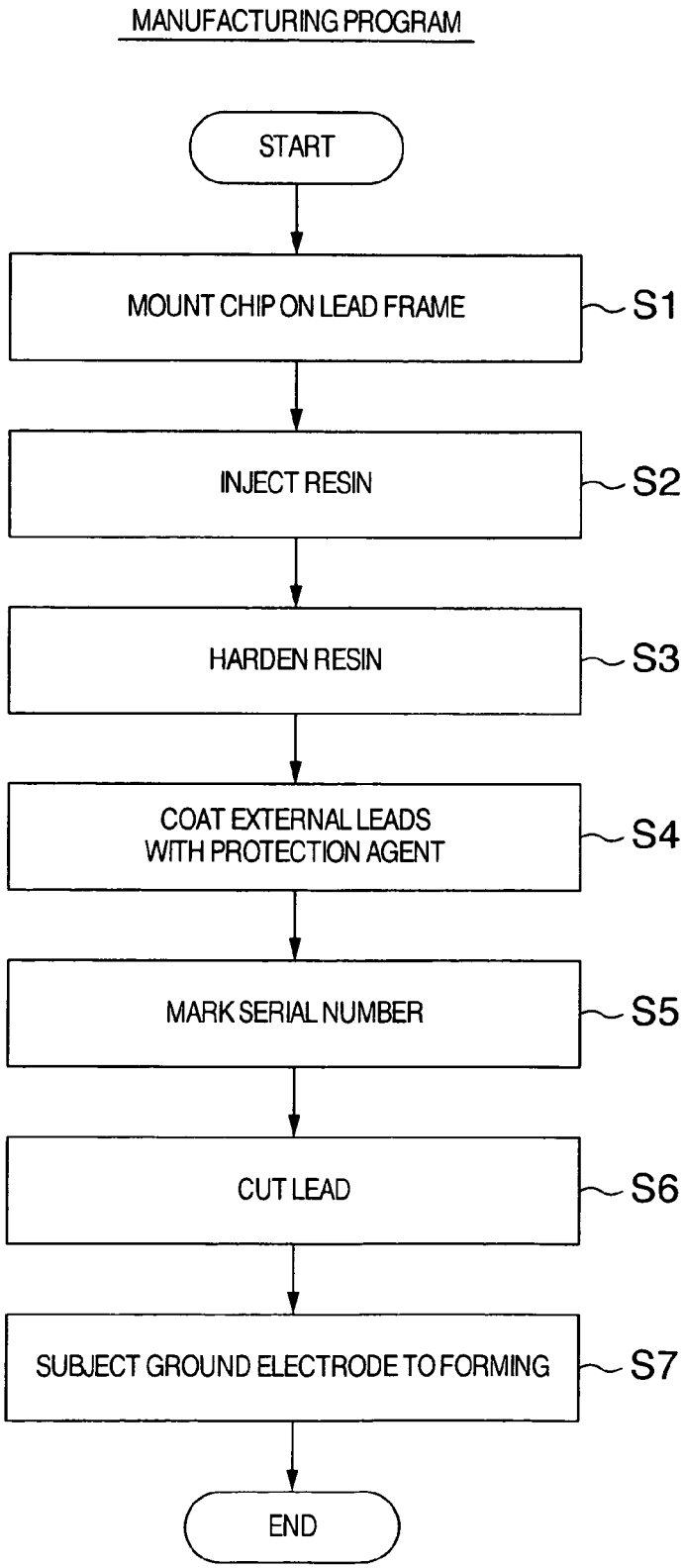
FIG. 9 is a flow chart showing the process for manufacturing the radio frequency IC tag by using the lead frame of the first variation shown in FIG. 8.

Next, the process for manufacturing the radio frequency IC tag by using the lead frame of the first variation shown in FIG. 8 is described. FIG. 9 is a flow chart showing the process for manufacturing the radio frequency IC tag by using the lead frame of the first variation shown in FIG. 8. First, the IC chip 35 is mounted on the radiating electrode 32 by the chip mounter not shown while the claws of the feeding mechanism of the chip mounter not shown are engaged with the feed holes 31*a* to move the lead frame 31 (step S1). The radiating electrode 32 is covered by a case and resin (sealing material) is injected therein (step S2). The resin is hardened (step S3) and then external leads are coated with a protection agent (step S4) A serial number is then marked thereon (step S5). A lead portion connecting the lead frame 31 and the radiating electrode 32 is cut (step S6) and then the ground electrode 33 is subjected to forming (step S7).

Figure 21A:
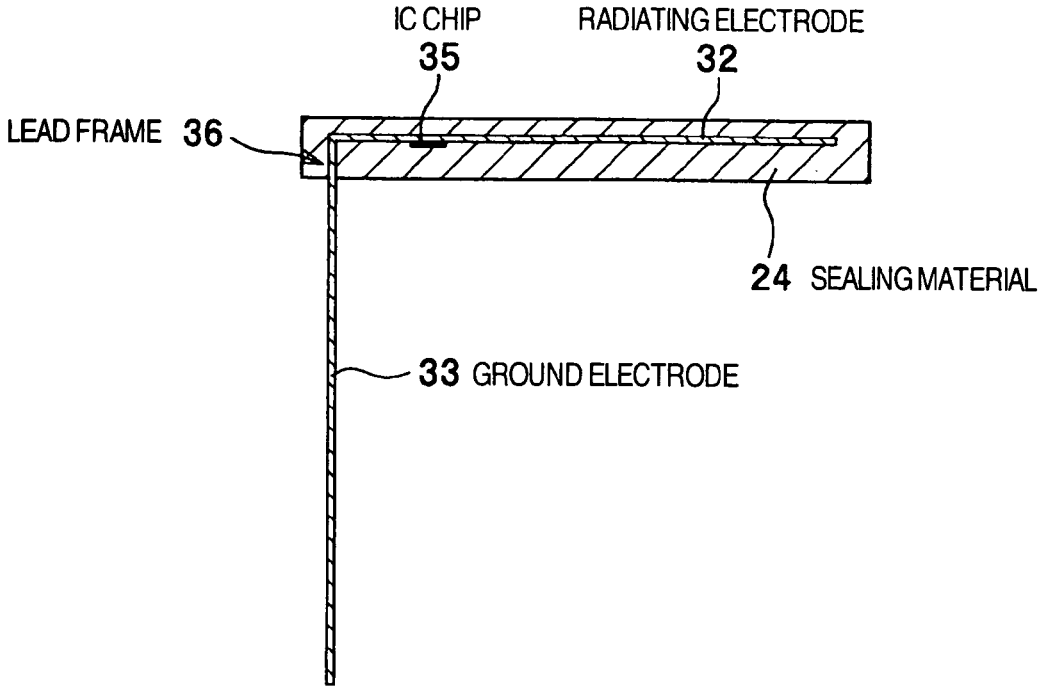
FIGS. 21A and 21B are diagrams illustrating the forming process of a ground electrode.
Figure 21B:
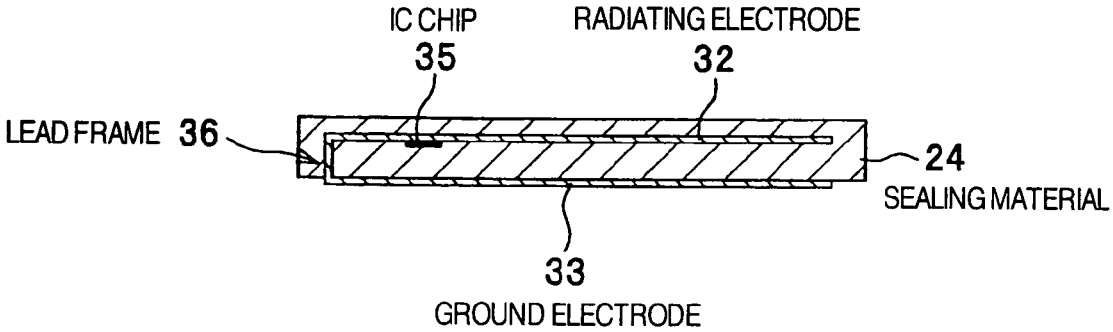

As shown in FIG. 21A, when the radiating electrode 32 is sealed with the sealing material 24 in the state that the lead frame 36 is bent at right angles, the ground electrode 33 is once subjected to forming or bent along the back side of the sealing material 24 as shown in FIG. 21B to thereby complete the process.

Figure 22A:
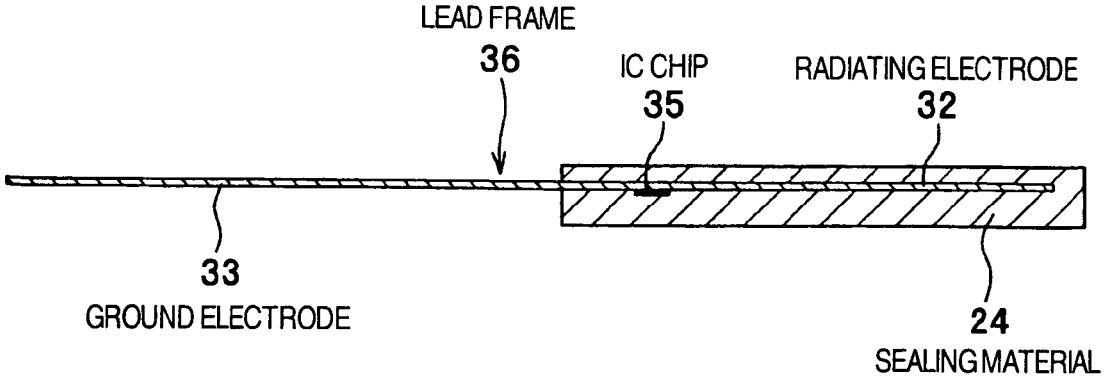
FIGS. 22A to 22C are diagrams illustrating the forming process of another ground electrode.
Figure 22B:
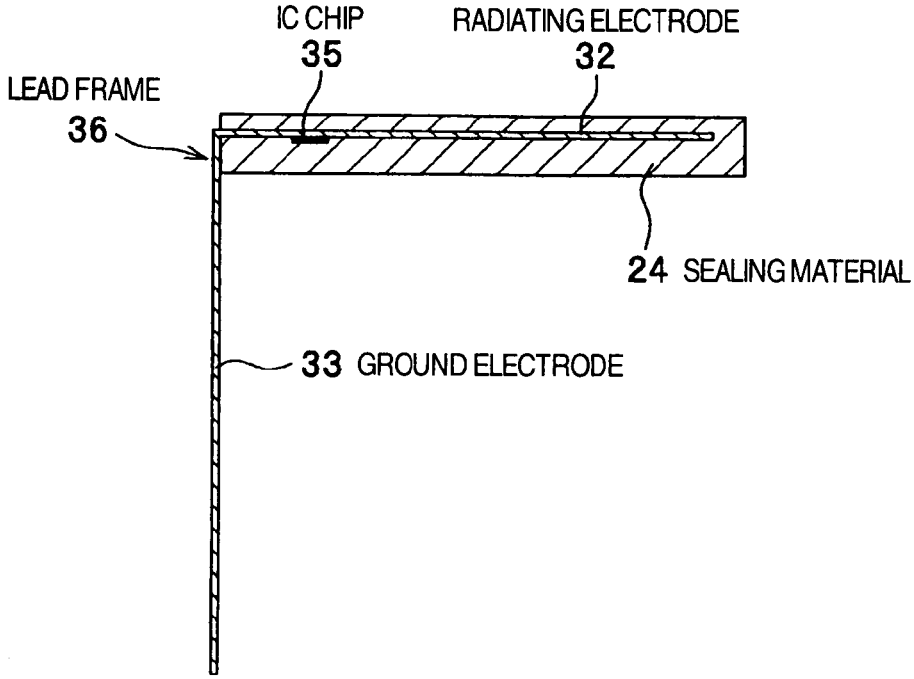
Figure 22C:
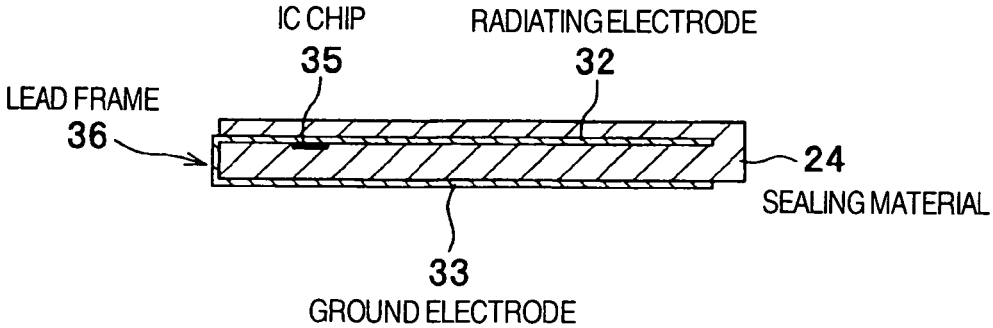

As shown in FIG. 22A, when the radiating electrode 32 is sealed with the sealing material 24 in the state that the radiating electrode 32, the lead frame 36 and the ground electrode 33 are on a plane, the lead frame 36 is first subjected to forming or bent along an end of the sealing material 24 as shown in FIG. 22B. Then, as shown in FIG. 22C, the ground electrode 33 is subjected to forming or bent along the back side of the sealing material 24 to thereby complete the process.

As described above, since the sealing material 24 can function as the insulating material 12, the radio frequency IC tag 11*a* shown in FIG. 5B can be obtained with the relatively simple process.

<Second Variation>

Figure 10:
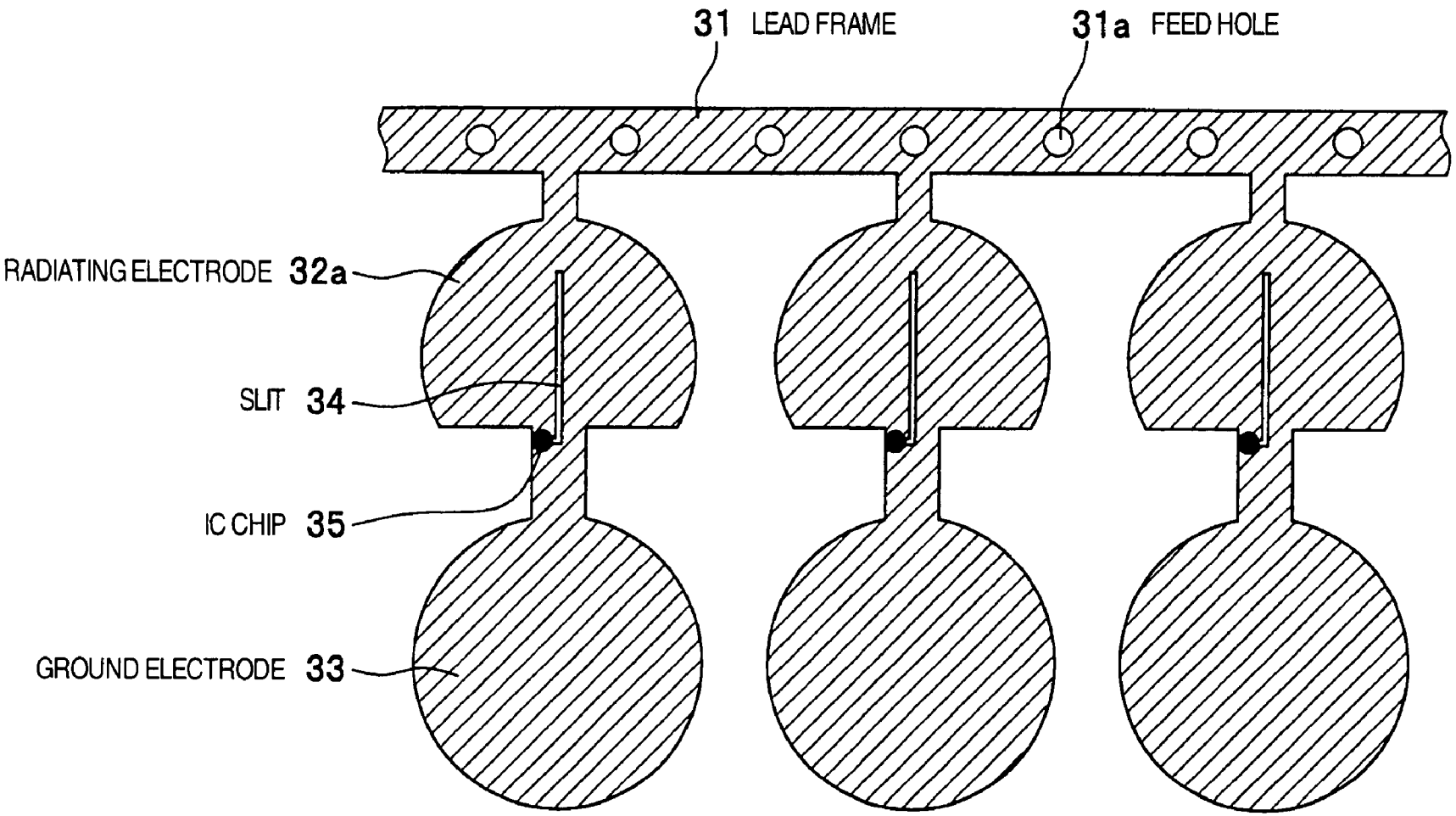
FIG. 10 is a diagram illustrating a second variation of the third embodiment according to the present invention in which a lot of radiating electrodes and ground electrodes are formed in a lead frame.

FIG. 10 is a diagram illustrating the second variation of the third embodiment according to the present invention in which a lot of radiating electrodes and ground electrodes are formed in a lead frame. The second variation is different from the first variation in that the radiating electrodes 32*a* are constituted by only upper semicircle instead of the semicircular radiating electrodes that are unsymmetrical in the vertical direction. Even the radiating electrodes 32*a* having such shape can be used to form the ground electrodes 33 into the same circle as the first variation. The process for manufacturing the radio frequency IC tag by using the lead frame of the second variation is the same as the flow chart of FIG. 9.

<Third Variation>

Figure 11:
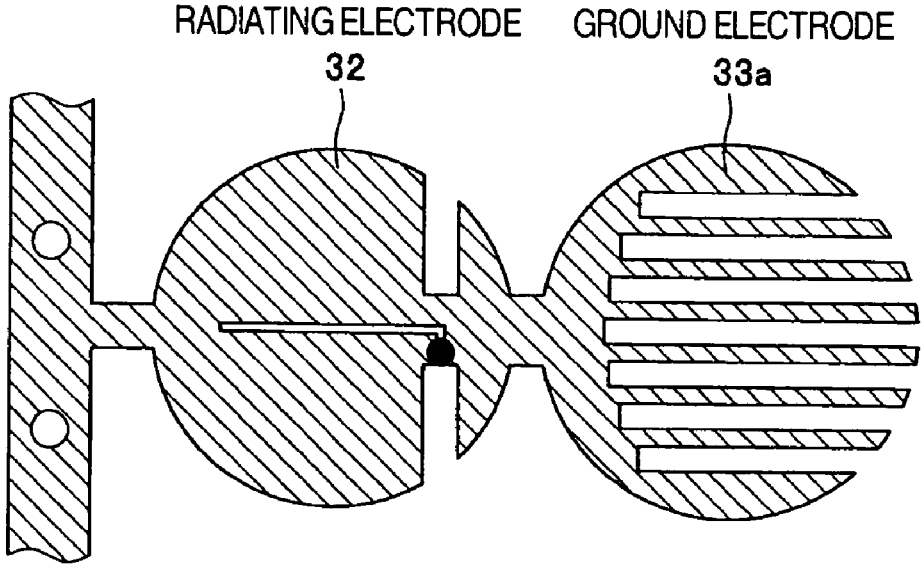
FIG. 11 is a diagram illustrating a third variation of the third embodiment according to the present invention including a radiating electrode having right and left unsymmetrical semicircles and a circular comblike ground electrode.

FIG. 11 is a diagram illustrating the third variation of the third embodiment according to the present invention including a radiating electrode having right and left unsymmetrical semicircles and a circular comblike ground electrode. As shown in the third variation of FIG. 11, even when the circular ground electrode 33*a* having a lot of slits is disposed opposite to the radiating electrode 32 having right and left unsymmetrical semicircles, the radio frequency IC tag of the present invention can be formed. In this manner, by providing the ground electrode 33*a* having the lot of slits, even if there is unevenness in the bottom of the hole of the metal material 14 connected to the ground electrode 33*a* as shown in FIG. 3, for example, the unevenness can be absorbed by the lot of slits of the ground electrode 33*a* and accordingly the adhesive properties between the ground electrode 33*a* and the metal material 14 can be improved. The process for manufacturing the radio frequency IC tag by using the lead frame of the third variation is the same as the flow chart of FIG. 9.

<Fourth Variation>

Figure 12:
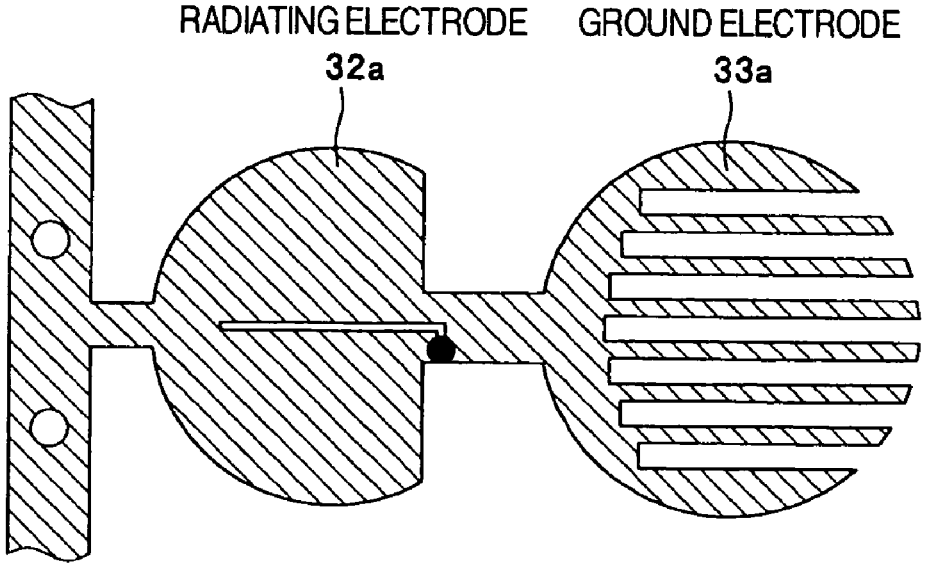
FIG. 12 is a diagram illustrating a fourth variation of the third embodiment according to the present invention including a semicircular radiating electrode disposed only on the left side and a circular comblike ground electrode.

FIG. 12 is a diagram illustrating the fourth variation of the third embodiment according to the present invention including a semicircular radiating electrode disposed only on the left side and a circular comblike ground electrode. As shown in the fourth variation of FIG. 12, even when a circular ground electrode 33*a* having a lot of slits is disposed opposite to the semicircular radiating electrode 32 disposed only on the left side, the radio frequency IC tag of the present invention can be formed. In this manner, by providing the ground electrode 33*a* having the lot of slits, even if there is unevenness in the bottom of the hole of the metal material 14 connected to the ground electrode 33*a* as described in connection with FIGS. 3A and 3B, for example, the unevenness can be absorbed by the lot of slits of the ground electrode 33*a* and accordingly the adhesive property between the ground electrode 33*a* and the metal material 14 can be improved. The process for manufacturing the radio frequency IC tag by using the lead frame of the fourth variation is the same as the flow chart of FIG. 9.

<Fifth Variation>

Figure 13:
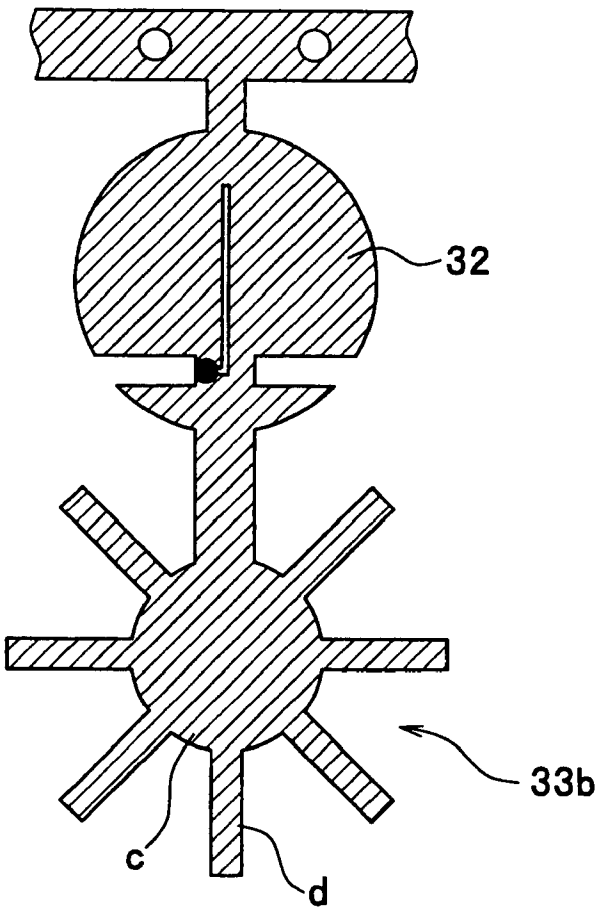
FIG. 13 is a diagram illustrating a fifth variation of the third embodiment according to the present invention including a radiating electrode having vertically unsymmetrical semicircles and a radial ground electrode.

FIG. 13 is a diagram illustrating the fifth variation of the third embodiment according to the present invention including a radiating electrode having vertically unsymmetrical semicircles and a radial ground electrode. As shown in the fifth variation of FIG. 13, even when the ground electrode 33*b* having a plurality of radial ends d disposed equi-angularly about a circular portion c is disposed opposite to the radiating electrode 32 having vertically unsymmetrical semicircles, the radio frequency IC tag of the present invention can be formed. Consequently, the ground electrode 33*b* can exhibit flexibility and even if there is unevenness in the bottom of the hole of the metal material 14 as described in connection with FIGS. 3A and 3B, for example, the unevenness can be absorbed and accordingly the adhesive property between the ground electrode 33*a* and the metal material 14 can be improved.

Figure 14:
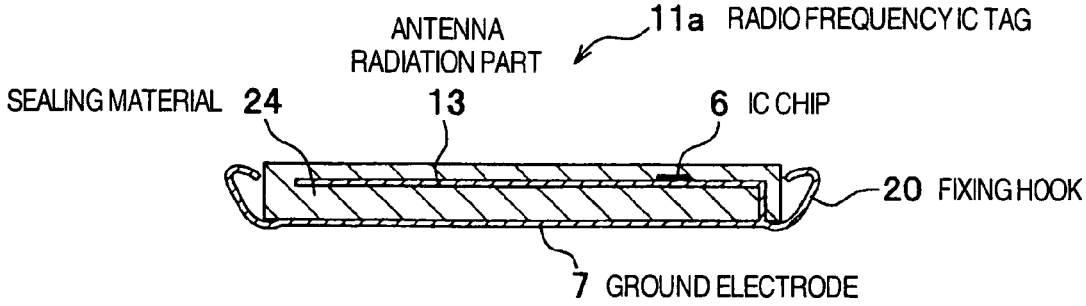
FIG. 14 is a diagram illustrating the radio frequency IC tag having fixing hooks formed therein.
Figure 15:
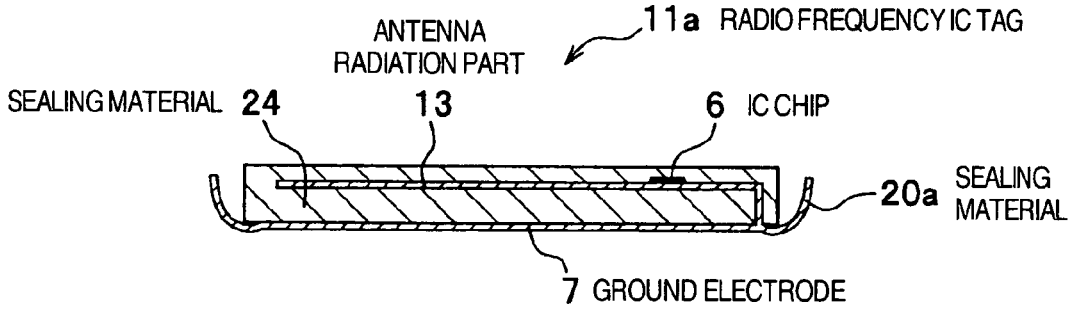
FIG. 15 is a diagram illustrating the radio frequency IC tag having fixing hooks formed therein.

In this case, the radial ends d are formed to be long and the ground electrode 33*b* is subjected to forming in accordance with the manufacturing process of FIG. 9. Then, lead portions jutting out of the sealing material 24 are further subjected to forming to make it possible to form fixing hooks 20 at the outer periphery of the sealing material 24 as shown in FIGS. 14 and 15.

Figure 16:
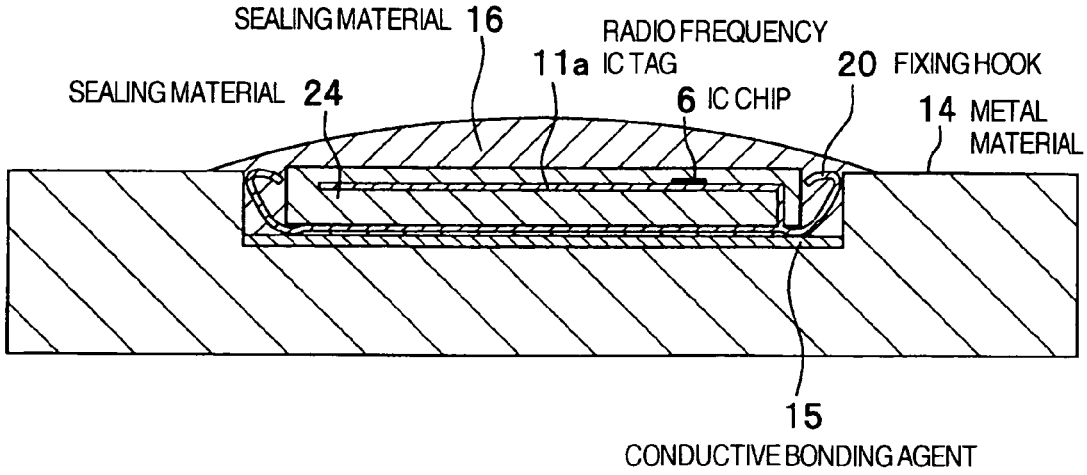
FIG. 16 is a diagram illustrating the radio frequency IC tag attached to metal material by means of fixing hooks.

In this manner, by forming the fixing hooks 20 at the outer periphery of the sealing material 24, the radio frequency IC tag 11*a* can be pressed into the hole of the metal material 14 to be fixedly mounted easily as shown in FIG. 16. Further, at this time, since electrical connection between the metal material 14 and the fixing hooks 20 can be made at the same time, use of the conductive bonding agent 15 can be omitted.

Figure 17:
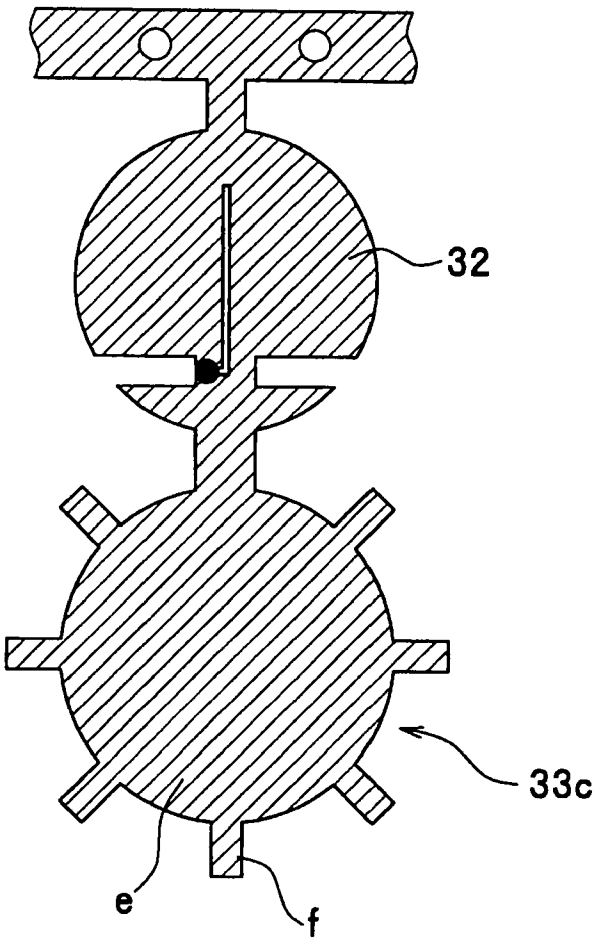
FIG. 17 is a diagram illustrating modified radial ground electrode.

Further, the ground electrode 33*c* can be formed as shown in FIG. 17. In FIG. 17, an circular portion e having the radial ends f formed therein is substantially identical in size with the radiating electrode 32. In this case, the function for absorbing unevenness is not obtained, although the lead portions jutting out of the sealing material 24 are subjected to forming to make it possible to form the fixing hooks 20. In this manner, since the area of the ground electrode 33*c* can be made larger than that of the radiating electrode 32, the antenna efficiency is not reduced even if the member to which the radio frequency IC tag is attached is not made of metal material.

Further, the process for manufacturing the radio frequency IC tag by using the lead frame of the fifth variation is the same as the flow chart of FIG. 9.

Fourth Embodiment

Some variations of the radiating electrode according to the fourth embodiment are now described. As described in the first embodiment, the radiating antenna can be formed by H-shaped antenna and polygonal antenna in addition to O-shaped antenna.

<First Variation>

Figure 18:
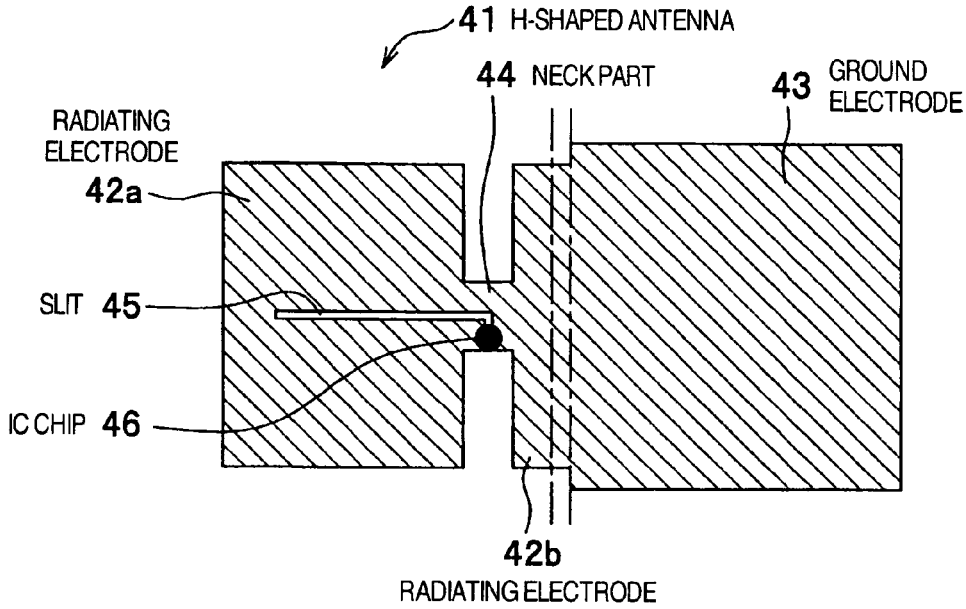
FIG. 18 is a plan view illustrating radiating electrodes and a ground electrode of an H-shaped antenna of a first variation of a fourth embodiment according to the present invention.

FIG. 18 is a plan view illustrating radiating electrodes and a ground electrode of an H-shaped antenna of the first variation of the fourth embodiment according to the present invention. As shown in FIG. 18, the H-shaped antenna 41 includes right and left unsymmetrical radiating electrodes 42*a* and 42*b* and an elongated neck part 44 connecting the radiating electrodes 42*a* and 42*b* at the middle portion thereof. Further, a slit 45 is formed from the elongated neck part 44 into the radiating electrode 42*a*. An IC chip 46 is mounted to straddle the slit 45 in the elongated neck part 44 and the respective terminals of the IC chip 46 are connected to electrodes on both sides of the slit 45. A rectangular ground electrode 43 having a large area is formed on the side of the radiating electrode 42*b*. Since the ground electrode 43 is rectangular, it is not necessary to narrow the lead frame as the lead frame 36 connecting the radiating electrode 32 and the ground electrode 33 of the O-shaped antenna of FIG. 8 and the lead frame for connecting the radiating electrode 42*b* and the ground electrode 43 of the H-shaped antenna 41 can be formed with the same width as the radiating electrode 42*b* as shown by two one-dot chain lines.

<Second Variation>

Figure 19:
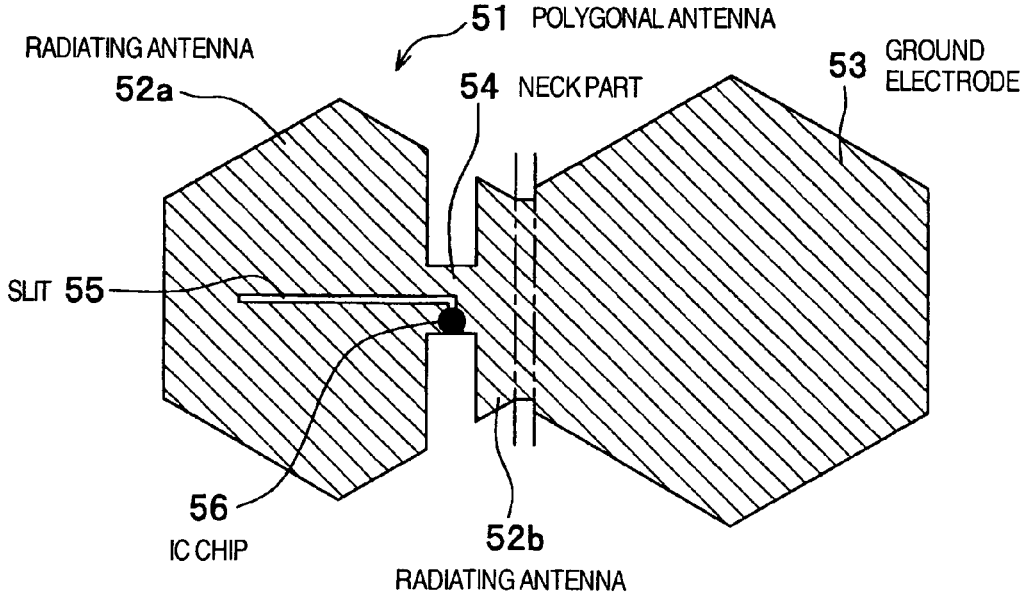
FIG. 19 is a plan view illustrating radiating electrodes and a ground electrode of a polygonal antenna of a second variation of the fourth embodiment according to the present invention.

FIG. 19 is a plan view illustrating radiating electrodes and a ground electrode of a polygonal antenna of the second variation of the fourth embodiment according to the present invention. As shown in FIG. 19, the polygonal antenna 51 (hexagonal antenna in the example of FIG. 19) includes right and left unsymmetrical radiating electrodes 52*a* and 52*b* and an elongated neck part 54 connecting the radiating electrodes 52*a* and 52*b* at the middle portion thereof. Further, a slit 55 is formed from the elongated neck part 54 into the radiating electrode 52*a*. An IC chip 56 is mounted to straddle the slit 55 in the elongated neck part 54 and the respective terminals of the IC chip 56 are connected to electrodes on both sides of the slit 55. A hexagonal ground electrode 53 having a large area is formed on the side of the radiating electrode 52*b*. Since the ground electrode 53 is hexagonal, it is not necessary to narrow the lead frame as the lead frame 36 connecting the radiating electrode 32 and the ground electrode 33 of the O-shaped antenna of FIG. 8 and the lead frame for connecting the radiating electrode 52*b* and the ground electrode 53 can be formed with the same width as a side of the radiating electrode 52*b* as shown by two one-dot chain lines.

Fifth Embodiment

Figure 20A:
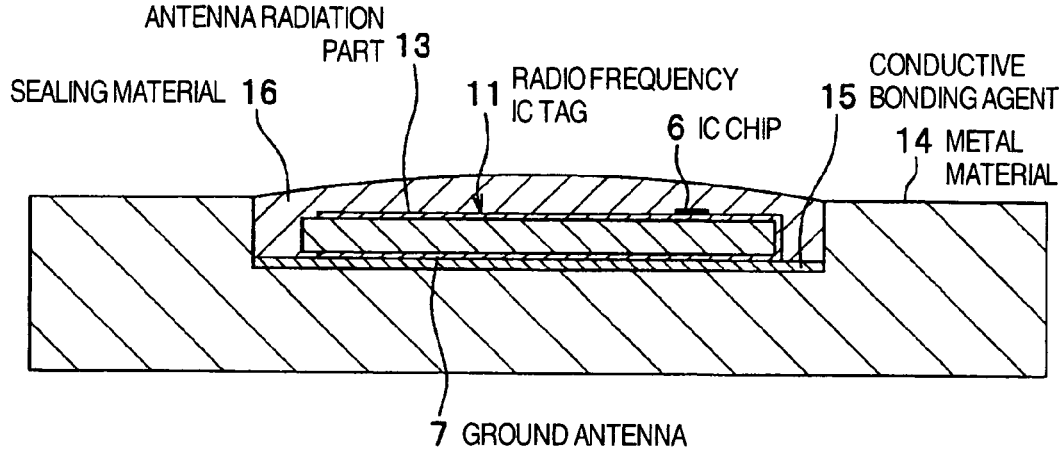
FIGS. 20A to 20C are diagrams illustrating a radio frequency IC tag including the auxiliary antenna in a fifth embodiment of the present invention.
Figure 20B:
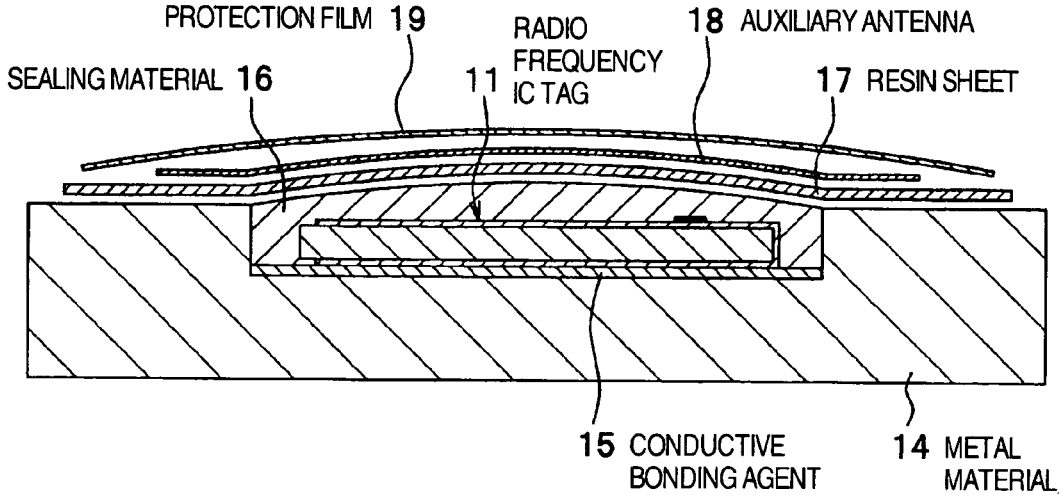
Figure 20C:
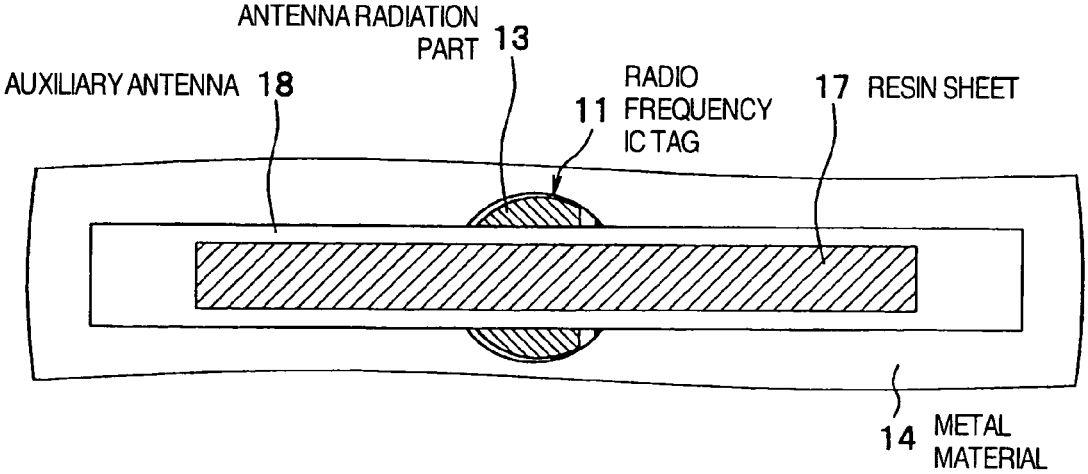

As the fifth embodiment, the radio frequency IC tag including an auxiliary antenna for further extension of the communication distance is described. FIGS. 20A to 20C are diagrams illustrating the radio frequency IC tag including the auxiliary antenna in the fifth embodiment of the present invention. FIG. 20A is a sectional view of the radio frequency IC tag including no auxiliary antenna, FIG. 20B is a sectional view of the radio frequency IC tag including the auxiliary antenna and FIG. 20C is a top view of the radio frequency IC tag shown in FIG. 20B.

As shown in FIG. 20A, a hole is formed in the metal material 14 constituting the head of a bolt and a conductive bonding agent 15 is applied on the bottom of the hole. The radio frequency IC tag 11 is embedded into the hole. A gap between the metal material 14 and the radio frequency IC tag 11 within the hole and the upper portion of the radio frequency IC tag 11 are filled with a sealing material 16 such as epoxy resin to seal the hole. Consequently, the radio frequency IC tag is attached to the metal material 14 in the state that the antenna radiating part 13 to which the IC chip 6 is attached is turned upward and the ground electrode 7 is electrically connected to the metal material 14. Then, an external antenna including a resin sheet 17 (nonmagnetic sheet), an auxiliary antenna 18 put on the resin sheet 17 and a protection film 19 put on the auxiliary antenna 18 is disposed on the surface of the radio frequency IC tag 11.

The resin sheet 17 may be a sheet made of polyethylene, polypropylene, Teflon (registered trademark), vinyl chloride, synthetic rubber or the like or a foamed sheet having the surface on which urethane adhesive is applied. The external antenna is a lamination structure of the resin sheet 17, the auxiliary antenna 18 disposed on the resin sheet 17 and made of conductive material such as aluminum or copper and the protection film 19 disposed on the auxiliary antenna 18 and made of polypropylene.

The resin sheet 17 has the thickness of 0.5 to 2 mm and the auxiliary antenna 18 is made of foil having the thickness of 7 μm. The protection film 19 has the thickness of 50 to 200 μm. Accordingly, the external antenna has predetermined flexibility and can be fixedly adhered to the surface of the metal material 14.

Further, when the metal material 14 is magnetic metal such as iron, a magnetic sheet can be used instead of the resin sheet 17. In this case, the external antenna can be fixed to the metal material by the magnetic force.

The antenna radiating part 13 has the diameter of 10 mm with which the communication distance of about 20 mm is obtained and the auxiliary antenna 18 has the width of 5 mm and the length of 50 mm. The length of the auxiliary antenna 19 is set to be a half thereof in accordance with the wavelength λ of radio wave. The resin sheet 17 may be of any size as far as it is larger than the auxiliary antenna 18 but has the width of 9 mm and the length of 60 mm, for example.

The length of the auxiliary antenna 18 is preferably equal to the length of λ/2 where λ is the wavelength of radio wave. Further, when the metal material 14 is made of nonmagnetic material such as aluminum, the resin sheet 17 is stuck on the metal material 14 as an antenna substrate of the auxiliary antenna 18, although when the metal material 14 is made of magnetic material such as iron, a magnetic sheet can be used as the antenna substrate to thereby attach or detach the auxiliary antenna simply.

When the radio frequency IC tag is equipped with the auxiliary antenna 18 as described above, the auxiliary antenna 18 is resonated with radio wave by the radiating electrode of the radio frequency IC tag 11 to make amplification and radiates strong radio wave outside. Accordingly, the communication distance that is 20 mm when the antenna 18 is not attached can be extended to 100 mm. In other words, the usual radio frequency IC tag 11 as shown in FIG. 20A is used for the usual communication distance and when it is necessary to further extend the communication distance, the auxiliary antenna 18 can be mounted as shown in FIG. 11B, so that the radio frequency IC tag can be utilized in the wide application ranging from the short communication distance to the long communication distance.

Further, there is theoretically known that the communication distance is longest when the length of the auxiliary antenna 18 is equal to a half (that is, λ/2) of the wavelength of radio wave having a predetermined frequency (2.45 GHz) used to read information from the radio frequency IC tag. However, the length of the auxiliary antenna 18 is varied depending on the dielectric constant of the resin sheet 17 (or magnetic sheet). For example, when the resin sheet 17 (or magnetic sheet) uses insulating material having the increased dielectric constant, the length of the auxiliary antenna 18 can be made short.

As described above, since the communication distance, the length of the auxiliary antenna 18 and the dielectric constant of the resin sheet 17 have the trade-off relation to one another, the insulating material having the proper dielectric constant can be selected to thereby shorten the size in the longitudinal direction of the auxiliary antenna 18.

The radio frequency IC tag according to the present invention is formed into the three-layer antenna structure in which the insulator containing resin, air, gas or vacuum is disposed between the radiating electrode formed into O-shape, polygon or H-shape and the ground electrode disposed opposite to the radiating electrode. Further, the IC chip is mounted on the upper surface or lower surface of the radiating electrode and the impedance matching circuit (that is, slit) for matching the impedance between the antenna and the IC chip is disposed in the portion where the IC chip is mounted. The radiating electrode having the small radiation area and the ground electrode are connected to each other at the side of the insulating material or by means of the through-holes.

Further, the ground electrode of the radio frequency IC tag and the metal material that is the body to which the radio frequency IC tag is mounted are formed into the electrically connected tag mounting structure. At this time, the ground electrode of the radio frequency IC tag and the metal material are fixedly mounted by the conductive material. The insulating material between the radiating electrode disposed on the upper side and the ground electrode disposed on the lower side uses semiconductor package material such as epoxy resin.

Further, by disposing the auxiliary antenna on the radio frequency IC tag assembled in the metal material, the communication distance can be further extended. At this time, the sheet-like antenna substrate such as adhesive resin sheet or magnetic sheet is covered on the metal material in which the radio frequency IC tag is embedded and the auxiliary antenna is disposed on the antenna substrate. Further, an adhesive is applied to the lower surface of the auxiliary antenna to enhance the adhesive force of the auxiliary antenna to the antenna substrate.

As described above, since the radio frequency IC tag of the embodiment can ensure the long communication distance even if the antenna is small in size, the radio frequency IC tag can be mounted in the structure formed of the metal material and the combined position of the structures can be managed. Accordingly, the radio frequency IC tag can be utilized in the construction field, the assembling field of machine and the like effectively.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A method for manufacturing a radio frequency IC tag including an IC chip for recording information and an antenna for transmitting the information recorded in the IC chip by radio, comprising the steps of:

forming a lead frame including a radiating electrode having a neck part and radiating parts of radio wave spreading on both sides of the neck part and a ground electrode connected to the radiating part;

mounting the IC chip in the neck part;

injecting resin into the radiating electrode;

hardening the injected resin;

coating a portion of the lead frame projecting outside of the radiating electrode with a protection agent;

cutting the radiating electrode from the lead frame; and forming the ground electrode along the surface of the hardened resin.

2. The method according to claim 1, wherein the step of forming the lead frame comprises forming the radiating electrode into an offset structure so that areas of the radiating parts existing on both sides of the feeding part are nonsymmetrical.

3. The method according to claim 2, wherein the radiating electrode is structured so that each of the radiating parts existing on both sides of the feeding part is formed into a semicircle and the feeding part and the radiating parts are formed into a circle.

4. The method according to claim 2, wherein the radiating electrode is structured so that the feeding part and the radiating parts existing on both sides thereof are formed into an H-shape.

5. The method according to claim 2, wherein the radiating electrode is structured so that the feeding part and the radiating parts existing on both sides thereof are formed into a polygon.

6. The method according to claim 1, wherein the step of forming the lead frame comprises electrically connecting the radiating electrode and the ground electrode to each other at the side of the dielectric body.

7. The method according to claim 1, wherein the step of forming the lead frame comprises electrically connecting the radiating electrode and the ground electrode to each other through through-holes formed in the dielectric body.

8. The method according to claim 1, wherein the step of forming the lead frame comprises disposing the dielectric body between the radiating electrode and the ground electrode and wherein the dielectric body is made of any of ceramic, resin, air or inert gas having a predetermined dielectric constant.

9. The method according to claim 1, wherein the step of mounting the IC chip comprises disposing the IC chip on the surface or the back of the feeding part in the radiating electrode.

10. The method according to claim 1, wherein the radiating electrode is formed with a slit for matching an impedance between the IC chip and the antenna and the IC chip is mounted to straddle the slit so that terminals of the IC chip are connected to electrodes on both sides of the slit.

11. The method according to claim 1, further comprising a step of electrically connecting the ground electrode to metal material constituting a mounting body.

12. The method according to claim 11, wherein the ground electrode is fixedly mounted to the metal material by means of conductive material.

13. The method according to claim 1, further comprising a step of disposing an auxiliary antenna on the surface of the radiating electrode with a dielectric sheet.

14. The method according to claim 13, wherein the auxiliary antenna has length equal to $\lambda/2$ where $\lambda$ is a wavelength of a radio wave radiated by the radiating electrode.

15. The method according to claim 13, wherein the auxiliary antenna has length that is varied depending on a dielectric constant of the dielectric sheet.

16. The method according to claim 15, wherein the auxiliary antenna has length that is set to be short when the dielectric constant of the dielectric sheet is large and is set to be long when the dielectric constant of the dielectric sheet is small.

17. The method according to claim 13, wherein the dielectric sheet is a nonmagnetic sheet formed of a sheet body made of any of polyethylene, polypropylene, Teflon®, vinyl chloride and synthetic rubber, the sheet body having a surface to which an adhesive is applied or a magnetic sheet.

18. The method according to claim 17, wherein the dielectric sheet uses the magnetic sheet when the metal material is magnetic material and the dielectric sheet uses the nonmagnetic sheet when the metal material is nonmagnetic material.

19. The method according to claim 13, wherein the auxiliary antenna is fixedly adhered to the dielectric sheet by an adhesive.

* * * * *